United States Patent [19]

Leonard

[11] Patent Number: 5,020,181

[45] Date of Patent: Jun. 4, 1991

[54] SCRAPING TOOL KIT

[76] Inventor: Douglas R. Leonard, Box #123, Rte. #12, Woodstock, Vt. 05091

[21] Appl. No.: 486,302

[22] Filed: Feb. 28, 1990

[51] Int. Cl.[5] ..... A47L 25/00

[52] U.S. Cl. ..... 15/105; 15/111; 15/236.05; 15/236.08; 7/170; 30/172; 51/181 R

[58] Field of Search ..... 15/105, 111, 143 R, 15/145, 236.05, 236.08; 30/172; 51/181 R, 181 NT; 7/114, 170; D4/116, 118; D32/46, 49

[56] References Cited

U.S. PATENT DOCUMENTS

| | | | |
|---|---|---|---|
| D. 204,480 | 4/1966 | Skarsten | 15/236.08 |
| 758,071 | 4/1904 | Hiles | 15/236.08 |
| 1,749,103 | 3/1930 | Kortick | 15/236.05 |
| 1,791,710 | 2/1931 | Bullock | 15/236.05 |
| 2,169,414 | 8/1939 | Giddings | 30/172 |
| 2,253,116 | 8/1941 | Findlay | 15/236.05 |
| 2,291,015 | 7/1942 | Anderson | 15/236.05 |
| 2,674,794 | 4/1954 | Barer | 15/105 |
| 2,711,552 | 6/1955 | Lengyel | 15/236.05 |
| 2,946,076 | 7/1960 | Morgan | 15/145 |
| 3,036,322 | 5/1962 | Jorgensen | 15/236.05 |
| 4,091,579 | 5/1978 | Giangiulio | 51/181 R |
| 4,146,943 | 4/1979 | Wertheimer et al. | 30/172 |
| 4,809,386 | 3/1989 | Re | 15/105 |

*Primary Examiner*—Harvey C. Hornsby
*Assistant Examiner*—Mark Spisich
*Attorney, Agent, or Firm*—Leon Gilden

[57] ABSTRACT

A kit arrangement includes an elongate handle, including a first and second section angularly offset relative to one another to enhance access to an interior surface of a lawn mower surface, with a scraping head mounted to the handle, incuding a chisel and serrated scraping edge mounted to a leg of the head spaced from and orthogonally oriented relative thereto. A honing and wire brush are mounted to the head to enhance its effectiveness in a cleaning and sharpening operation relative to a lawn mower.

1 Claim, 4 Drawing Sheets

SCRAPING TOOL KIT

BACKGROUND OF THE INVENTION

1. Field of the Invention

The field of invention relates to scraping tools, and more particularly pertains to a new and improved scraping tool kit wherein the same permits enhanced access and effectiveness in a cleaning and sharpening procedure of a bottom surface of a typical lawn mower deck.

2. Description of the Prior Art

Scraping tools of various types and applications have been provided in the prior art. In the typical cleaning of a lawn mower, access to a bottom surface thereof is frequently awkward and difficult to attain. Particular application of a scraping tool to this cleaning environment is particularly difficult and in this regard, the instant invention has directed a handle and associated head structure to enhance ease of access to various remote portions of an interior surface of a lawn mower and further provides a honing tool to permit sharpening of a lawn mower blade while in a cleaning operation, as well as enhanced cleaning thereof by a single tool. Examples of the prior art include U.S. Pat. No. 4,759,092 to Duddy provides an adjustable scraper with an elongate blade with an angularly offset head, wherein the head includes a blade mounted within a serrated scraping edge of the head.

U.S. Pat. No. 3,795,026 to Kazamek, et al, provides a hand held scraper with an elongated body formed with a serrated forward scraping edge and a rearwardly directed support handle.

U.S. Pat. No. 2,719,319 to Hauser sets forth a chopping and scraping instrument wherein an elongate blade includes a serrated forward end.

U.S. Pat. No. 3,377,642 to Reak sets forth a spline cleaning tool wherein a forward end of the tool includes a concave tool element formed with projections and notches to be received within an associated spline.

U.S. Pat. No. 4,305,175 to Burgee, Jr. provides a scraping tool for use in typical scaping of ice for an automobile windshield, wherein a shell includes a plurality of blades mounted to a support head to provide enhanced scraping of ice by the tool.

As such, it may be appreciated that there continues to be a need for a new and improved scraping tool kit wherein the same addresses both the problems of ease of use, as well as effectiveness in construction in providing a complete scraping and maintenance tool for the cleaning and sharpening of a conventional lawn mower and in this respect, the present invention substantially fulfills this need.

SUMMARY OF THE INVENTION

In view of the foregoing disadvantages inherent in the known types of scraping tools now present in the prior art, the present invention provides a scraping tool kit wherein the same provides an elongate handle with offset handle portions mounting a forwardly thereof to provide enhanced access of the blade to various portions of a lawn mower for cleaning and sharpening thereof. As such, the general purpose of the present invention, which will be described subsequently in greater detail, is to provide a new and improved scraping tool kit which has all the advantages of the prior art scraping tools and none of the disadvantages.

To attain this, the present invention provides a kit arrangement including an elongate handle, including a first and second section angularly offset relative to one another to enhance access to an interior surface of a lawn mower surface, with a scraping head mounted to the handle, including a chisel and serrated scraping edge mounted to a leg of the head spaced from and orthogonally oriented relative thereto. A honing and wire brush are mounted to the head to enhance its effectiveness in a cleaning and sharpening operation relative to a lawn mower.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciated that the conception, upon which this disclosure is based, may readily be utilized as a basis for the designing of other structures, methods and systems for carrying out the several purposes of the present invention. It is important, therefore, that the claims be regarded as including such equivalent construction insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved scraping tool kit which has all the advantages of the prior art scraping tools and none of the disadvantages.

It is another object of the present invention to provide a new and improved scraping tool kit which may be easily and efficiently manufactured and marketed.

It is a further object of the present invention to provide a new and improved scraping tool kit which is of a durable and reliable construction.

An even further object of the present invention is to provide a new and improved scraping tool kit which is susceptible of a low cost of manufacture with regard to both materials and labor, and which accordingly is then susceptible of low prices of sale to the consuming public, thereby making such scraping tool kits economically available to the buying public.

Still yet another object of the present invention is to provide a new and improved scraping tool kit which provides in the apparatuses and methods of the prior art some of the advantages thereof, while simultaneously overcoming some of the disadvantages normally associated therewith.

Still another object of the present invention is to provide a new and improved scraping tool kit providing enhanced access and effectiveness in the cleaning and maintenance of lawn mower assemblies.

These together with other objects of the invention, along with the various features of novelty which characterize the invention, are pointed out with particularly in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an orthographic side view, taken in elevation, of the scraping tool kit of the instant invention.

DESCRIPTION OF THE PREFERRED EMBODIMENT

Figure 1:
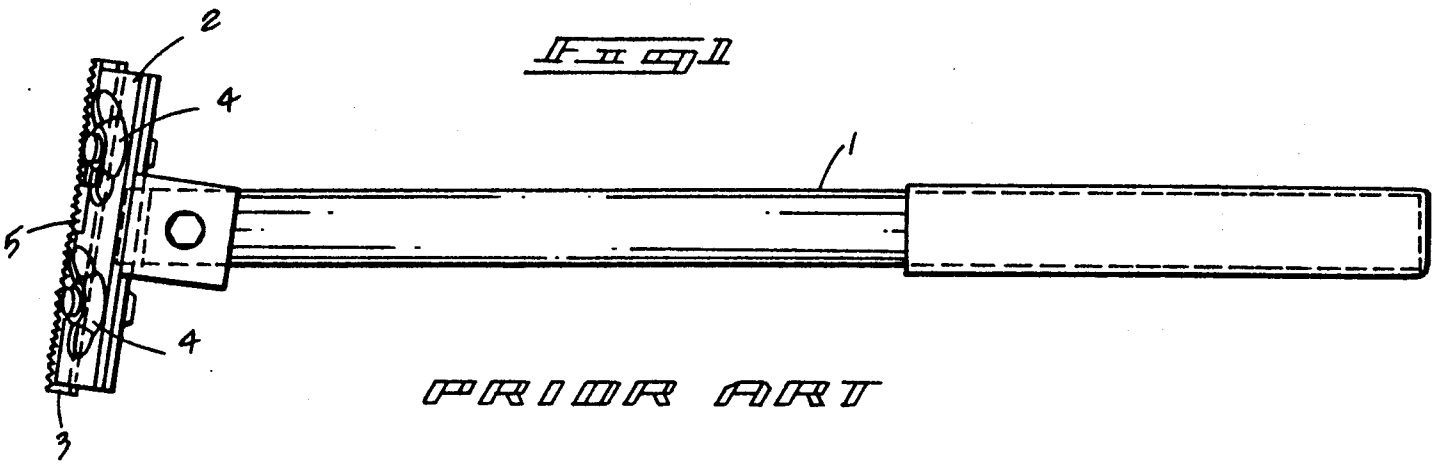
FIG. 1 PRIOR ART
FIG. 1 is a top orthographic view of a scraping tool utilized in the prior art.
Figure 2:
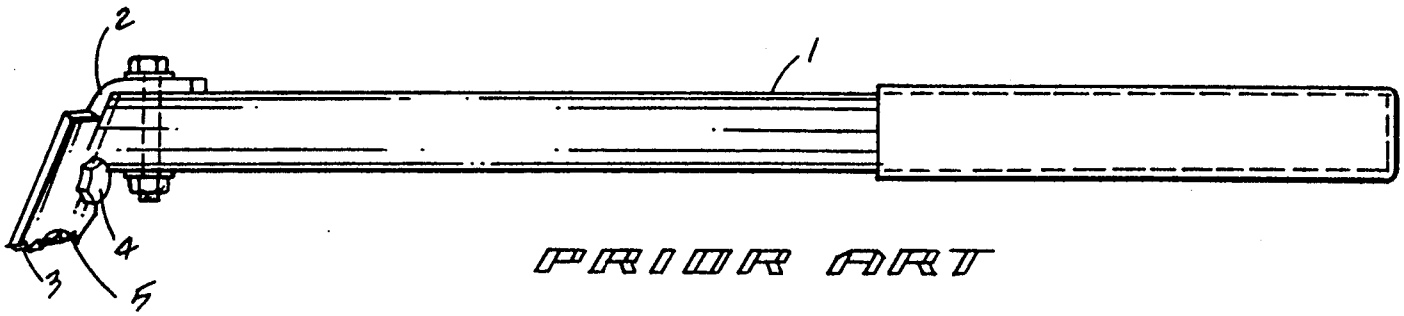
FIG. 2 PRIOR ART
FIG. 2 is an orthographic side view of the prior art scraping tool, as illustrated in FIG. 1.
Figures 4, 4A, 5:
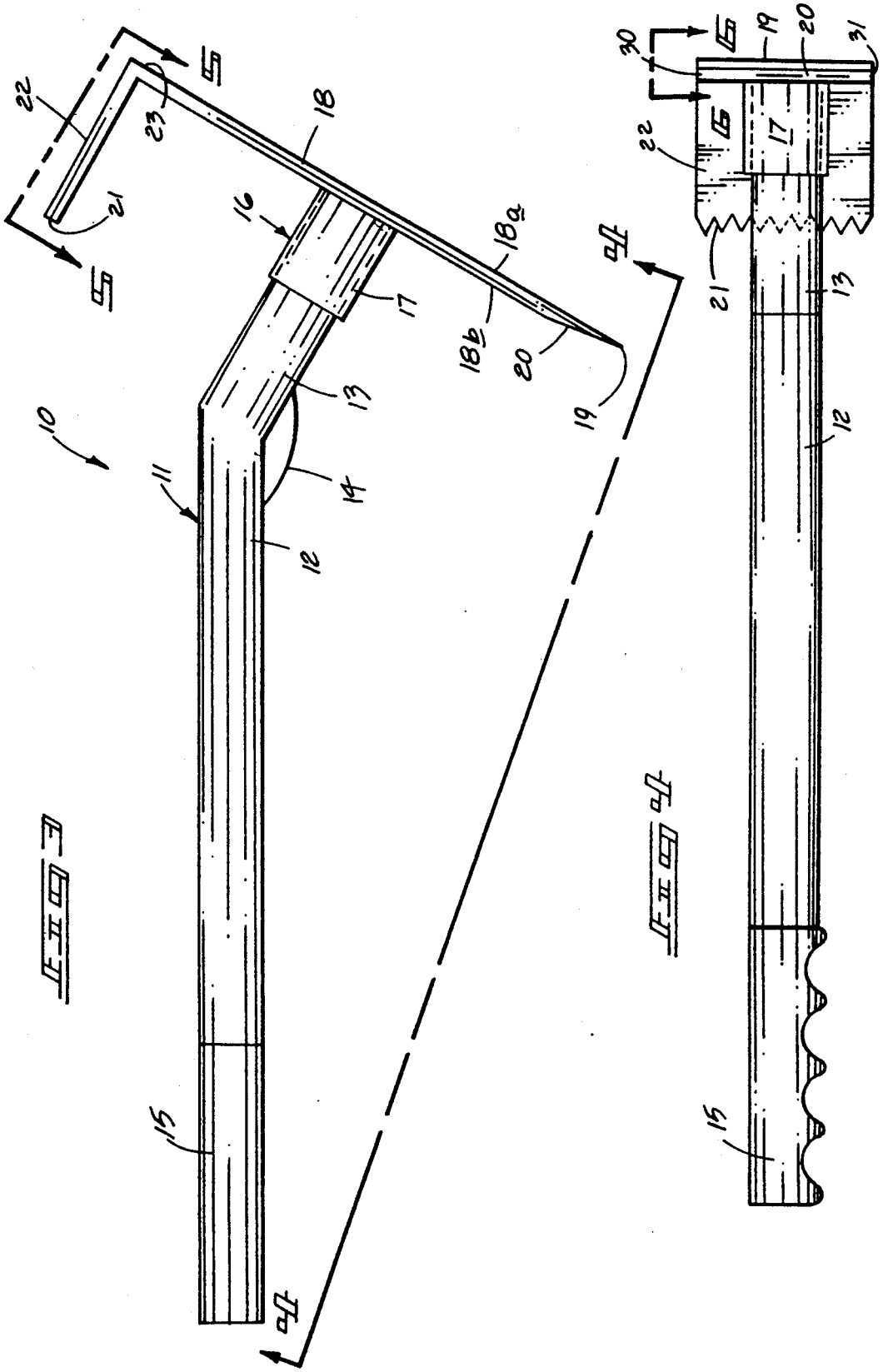
FIG. 4 is a orthographic view taken along the lines 4—4 of FIG. 3 in the direction indicated by the arrows.
FIG. 5 is an orthographic view taken along the lines 5—5 of FIG. 3 in the direction indicated by the arrows.
Figure 5:
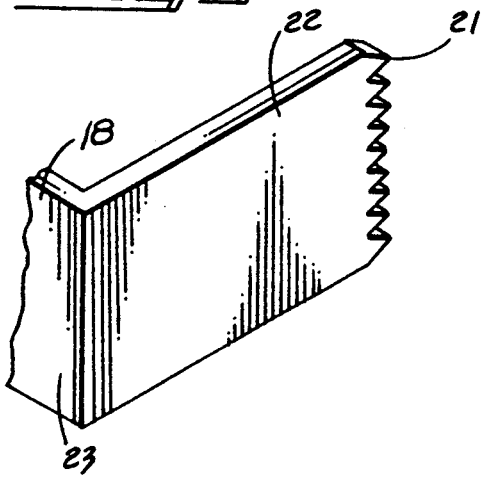
Figure 6:
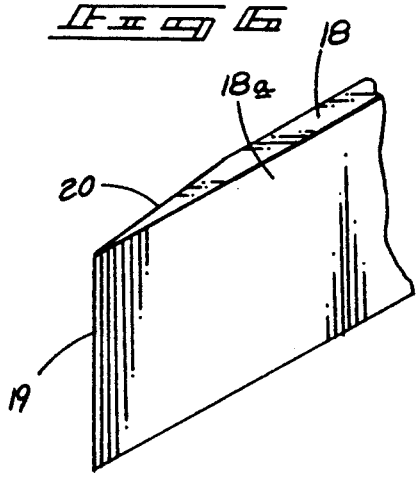
FIG. 6 is an orthographic view taken along the lines 6—6 of FIG. 4 in the direction indicated by the arrows.
Figure 7:
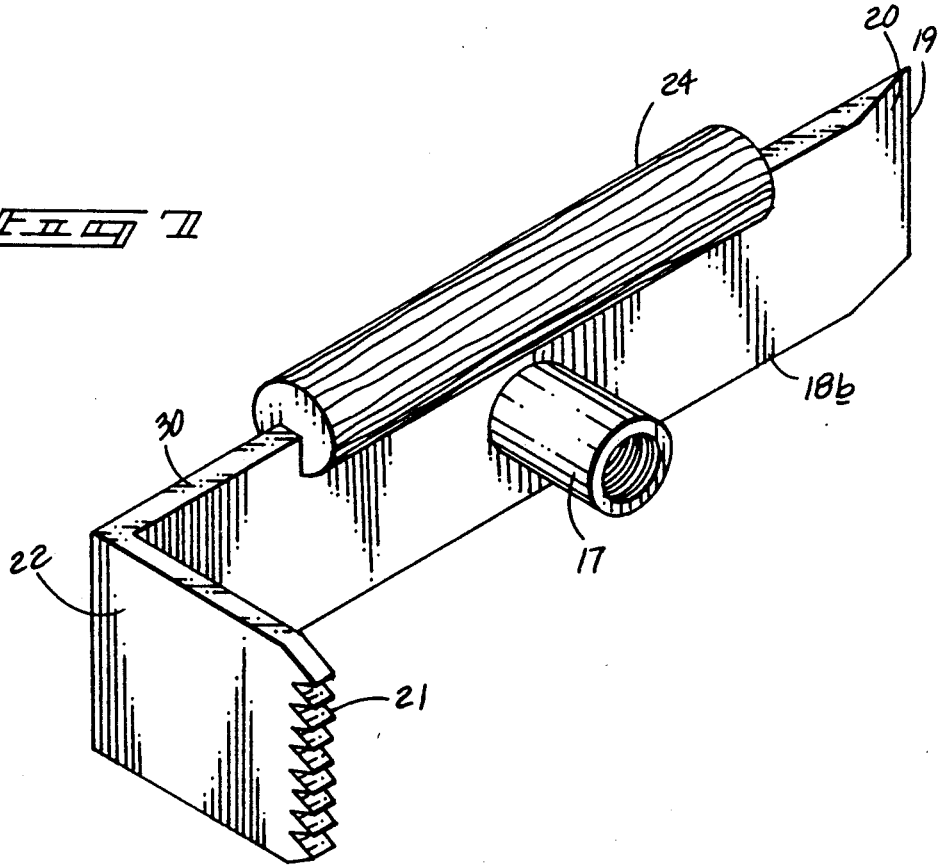
FIG. 7 is an isometric illustration of the scraping head member utilized by the instant invention, with a honing stone attached thereto.
Figure 8:
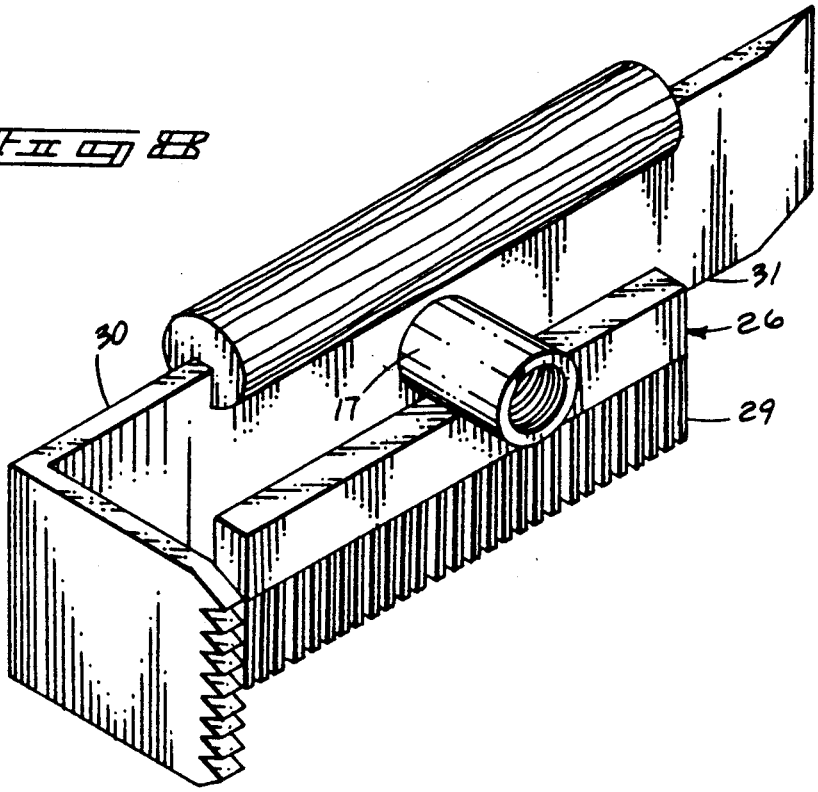
FIG. 8 is an isometric illustration of the scraping tool head of the instant invention utilizing a honing stone and brush mounted thereon.

With reference now to the drawings, and in particular to FIGS. 1 to 10 thereof, a new and improved scraping tool kit embodying the principles and concepts of the present invention and generally designated by the reference numeral 10 will be described.

FIG. 1 illustrates a prior art scraping tool including an elongate, longitudinally aligned handle formed with an offset head mounted thereto, wherein the head member 2 includes a plurality of fasteners 4 to secure a blade 3 to a forward end 5 of the head.

More specifically, the scraping tool 10 of the instant invention essentially comprises an elongate handle 11 including a first longitudinally aligned (i.e. straight) shank 12 integrally mounted to a second longitudinally aligned (i.e. straight) shank 13, with an obtuse included angle 14 defined therebetween. An interdigited resilient grip member 15 is mounted about a rearward terminal end portion of the first shank 12, with a scraping head 16 mounted to a forward terminal free end of the second shank 13. The scraping head 16 is orthogonally mounted to the second shank 13 and includes an internally threaded socket 17 to threadedly secure the scraping head 16 to the second shank 13. A planar elongate, longitudinally aligned central blade body 18 is orthogonally mounted to the socket 17 and includes a planar forward face **18*a* and a planar rear face 18*b*, wherein the planar rearward face 18*b* is defined by a lesser longitudinal extent than that of the forward face 18*a*. The lesser longitudinal extent of the rear face 18*b* is effected by a rearwardly tapering interior surface portion 20 directed downwardly terminating in a first elongate chisel edge 19 orthogonally aligned relative to the longitudinally alignment of the blade body 18. A planar leg 22 is integrally and orthogonally mounted to the blade body 18 at an upper terminal end 23 of the blade body, wherein a free rearwardly directed edge of the planar leg 22 terminates in a serrated second edge 21 generally parallel to the first elongate chisel edge 19. The rearwardly directed leg 22 and the serrated second edge 21 provide enhanced access to an interior skirt portion of a typical lawn mower, while the chisel edge 19 provides enhanced cleaning and access and due to the angular orientation of the second shank 13 relative to the first shank 12 and provides clearance to effect a scraping and cleaning operation to an interior portion of a lawn mower. The longitudinally aligned leg 22 is arranged generally parallel to the second shank 13**.

Figure 9:
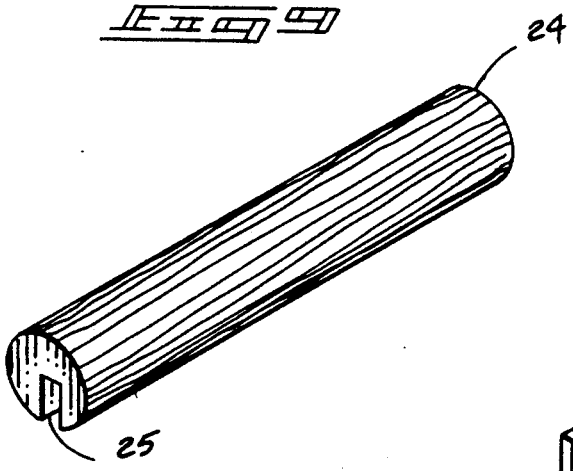
FIG. 9 is an isometric illustration of the honing stone utilized by the instant invention.
Figure 10:
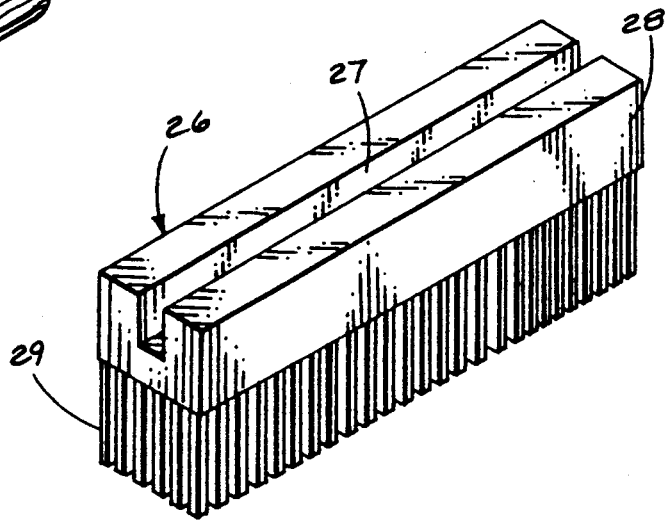
FIG. 10 is an isometric illustration of the wire brush utilized by the instant invention.

FIG. 9 illustrates the use of a cylindrical hone 24 formed with a radial slot 25 coextensively directed interiorly of the cylindrical hone 24, wherein the slot is defined by a width substantially equal to a width of the planar blade body 18. The planar blade body 18 ia formed with spaced first and second side edges 30 and 31 respectively that arranged parallel to one another, with the cylindrical hone 24 securable to the first side edge 30, and wherein the slot may be permanently mounted thereon by use of commercial adhesives. A wire brush head 26 is formed with a brush support head 28 that includes a longitudinal slot 27 equal to the predetermined width of the head 18 and is mounted to the second side edge 31 of the blade body 18, with a matrix of wire bristles 29 extending orthogonally and outwardly of the support head 28 on a side thereof opposed to that of the slot 27. The complete organization, as illustrated, permits a sharpening of an associated lawn mower blade of a lawn mower assembly (not shown) of conventional configuration, while access to the interior portion of the aforenoted lawn mower assembly is available to an individual. The brush member 26 permits a final thorough cleaning of the lawn mower during a cleaning procedure.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A scraping tool kit for cleaning and shaping of a lawn mower comprising, in combination, an elongate handle member, the elongate handle member including a planar longitudinally aligned central blade body orthogonally mounted to a forward end of the handle member, and the blade body including a first elongate chisel edge orthogonally aligned relative to the longitudinally aligned planar blade body at a lowermost terminal end thereof, and a serrated second edge arranged parallel to the first elongate chisel edge, wherein the serrated second edge is formed to a remote terminal end portion of the blade body, and wherein the remote end portion includes a planar leg, the planar leg integrally and orthogonally mounted to the planar blade body at an upper terminal end of the planar blade body spaced from the first chisel edge, and the planar leg terminating in the serrated second edge spaced and parallel to the chisel edge, and wherein the handle includes a first longitudinally aligned shank member integrally and angularly formed to a second longitudinally aligned shank members formed relative to one another defining an obtuse angle therebetween, and the planar leg arranged parallel to and spaced above the second shank, and wherein the planar blade body includes a first side edge and a second side edge arranged parallel to one another and orthogonally relative to the first chisel edge and the second serrated edge, and a rearwardly tapering interior surface of the blade body directed rearwardly of the first chisel edge in confronting relationship relative to the handle, and a socket orthogonally and medially mounted to an interior surface of the blade body secured to a forward end of the second shank defining the forward end of the handle, and further including a cylindrical hone adapted to sharpen a lawn mower blade of the lawn mower, the cylindrical hone including a radial slot directed interiorly and coextensively with the cylindrical hone from an exterior surface thereof interiorly thereof, and the cylindrical hone integrally mounted to the first side edge of the planar blade body, and further including a brush head mounted to the second side edge of the planar blade body spaced from the cylindrical hone to permit subsequent cleaning of a scraping procedure, and wherein the brush head includes a support base including a longitudinal slot, the longitudinal slot defined by a predetermined width equal to a predetermined width of the planar blade body defined by the first and second side edge, and the support base further including a matrix of wire bristles directed orthogonally and exteriorly of the support base remote from the longitudinal slot, and wherein the cylindrical hone and the support base are adhesively mounted to the respective first and second side edge.

* * * * *